United States Patent [19]

Koch et al.

[11] Patent Number: 4,475,452

[45] Date of Patent: Oct. 9, 1984

[54] BARK PROCESSING MACHINE

[75] Inventors: Klaus Koch, Laatzen; Gerhard Syrbius, Grossburgwedel, both of Fed. Rep. of Germany

[73] Assignee: Hermann Berstorff Maschinenbau GmbH, Fed. Rep. of Germany

[21] Appl. No.: 495,257

[22] Filed: May 17, 1983

[30] Foreign Application Priority Data

May 21, 1982 [DE] Fed. Rep. of Germany ..... 3219089

[51] Int. Cl.[3] ..... B30B 9/06

[52] U.S. Cl. ..... 100/117; 100/150; 144/208 R

[58] Field of Search ..... 100/117, 150; 144/208 R

[56] References Cited

U.S. PATENT DOCUMENTS

| | | | |
|---|---|---|---|
| 2,335,819 | 11/1943 | Upton | 100/150 |
| 3,877,365 | 4/1975 | Berggren | 100/117 |
| 4,357,665 | 11/1982 | Knuth et al. | 100/117 |

FOREIGN PATENT DOCUMENTS

| | | | |
|---|---|---|---|
| 2090542 | 7/1982 | United Kingdom | 100/117 |
| 2092014 | 8/1982 | United Kingdom | 100/117 |

*Primary Examiner*—W. D. Bray

*Attorney, Agent, or Firm*—Schwartz, Jeffery, Schwaab, Mack, Blumenthal & Koch

[57] ABSTRACT

A bark processing machine comprising a cylindrical tube with a driven screw disposed therein has a helical member on the screw formed by a plurality of highly abrasion-resistant and interchargeable segments. Preferably the segments have a stepped seat co-operating with a stepped seat on the pressure side of a base member of helical form welded to the core of the screw, the segments being secured to the base member by screws.

9 Claims, 4 Drawing Figures

BARK PROCESSING MACHINE

BACKGROUND OF THE INVENTION

The invention relates to a bark processing machine.

Bark processing machines have been previously proposed in which water is pressed out of the bark by compressing the bark in a tube by means of a rotatable screw which compresses the bark and conveys it along the tube. The bark is prevented from rotating with the screw by teeth extending from the inner wall of the tube. At the locations of the teeth, a helical member which with a core member forms the screw is interrupted.

The teeth prevent the bark from rotating with the screw and cause a pressure build up in the turns of the screw, causing water to be removed from the bark.

The pressure which builds up in the turns of the screw puts a considerable load on the helical member of the screw, so it is absolutely essential to have a very stable construction.

In addition there is considerable wear on the edge of the helical member, particularly when the bark is soiled.

SUMMARY OF THE INVENTION

The invention has among its objects to provide a bark processing machine capable of operating reliably for a long period. In particular it aims to avoid the need periodically to replace the screw due to wear.

According to the invention there is provided a bark processing machine, comprising a cylindrical tube with a funnel-shaped aperture for feeding in the bark; a rotatable screw disposed in the tube; a helical member disposed on the screw and defining with the wall of the tube an elongate helical chamber extending around the screw, in which chamber bark is conveyed by rotation of the screw and is put under pressure; teeth extending from the wall of the tube into the interior of the tube to restrict co-rotation of the bark with the screw, the helical member of the screw being interrupted at locations corresponding to the positions at which the teeth project into the tube; and apertures in the tube to drain-off liquid pressed out of the bark; wherein the helical member of the screw includes a plurality of interchangeable, highly wear-resistant part-helical segments.

The construction of the helical member of the screw in the form of individual part-helical segments, for example a peripheral arrangement of six identical parts screwed to the periphery of the screw in a helical shape, enables individual damaged segments readily to be replaced by new ones at any time.

The helical member can have only part of its cross-section in the form of an interchangeable abrasion segments. Thus a helical base member can be welded onto a core of the screw and the abrasion segments secured to the helical base member. A construction of this kind can give the interchangeable segments a secure hold on the core of the screw and only quite small segments of the highly abrasion resistant material need be exchanged.

The helical base member can if desired be formed integral with the core of the screw and formed by machining the core.

The individual segments may be made of highly wear-resistant hard metal, in the form of pieces of sintered metal, of a metal-ceramic compound or of a synthetic polymer provided with wear-resistant inserts.

Preferably the segments are identical to one another so that they can be interchanged with one another and storage is also very simple and inexpensive.

BRIEF DESCRIPTION OF THE APPLICATION DRAWING

The invention is illustrated by way of example in the accompanying drawing, in which.

DETAILED DESCRIPTION OF THE PREFERRED EMBODIMENTS

Figure 1:
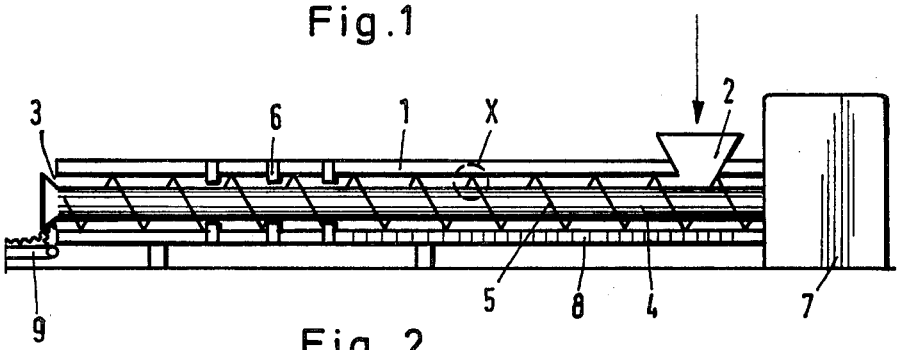
FIG. 1 is a schematic longitudinal section through a bark processing machine according to the invention.

Referring to the drawings a bark processing machine comprises a cylindrical tube 1 with a feed hopper 2 and a material discharge aperture 3.

A screw 4 with a helical member 5 mounted on it is disposed in the tube 1. The screw 4 is rotated by a drive unit 7.

Teeth 6 project through the wall of the tube 1, and the helical member 5 is cut away at locations corresponding to the positions at which the teeth are provided to prevent any damage to the helical member 5 by the teeth 6.

Bark to be processed is fed into the hopper 2, engaged by the helical member 5 and conveyed thereby towards the discharge aperture 3. When the teeth 6 engage the bark located between the turns of the helical member 5, a pressure builds up in the elongate helical chamber formed by the core of the screw 4, the helical member 5 and the inner wall of the tube and is propagated towards the feed aperture 2. This build up of pressure causes water to be pressed from the bark, the water flowing out of the tube 1 through apertures 8 located in the bottom of the tube 1.

The teeth 6 extend radially inwardly and are disposed at regular intervals around the periphery of the tube 1 and a plurality of sets of teeth 6 are disposed in respective transverse planes to give a high degree of compression. The dried bark fed out of the discharge aperture 1 is fed by a conveyor belt 9 to a combustion point.

Figure 2:
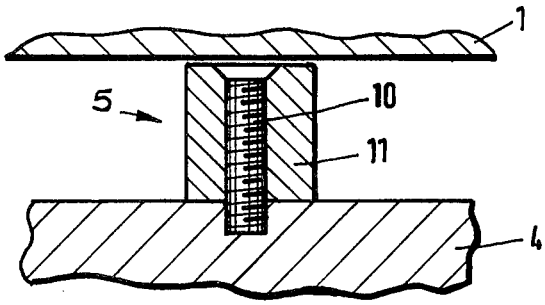
FIG. 2 shows to a greater scale the portion marked X in FIG. 1.

FIG. 2 shows a segment 11, forming part of the helical member 5, fixed onto the core of the screw 4 by a screw 10, the entire helical member 5 is made up of such segments 11.

Figure 3:
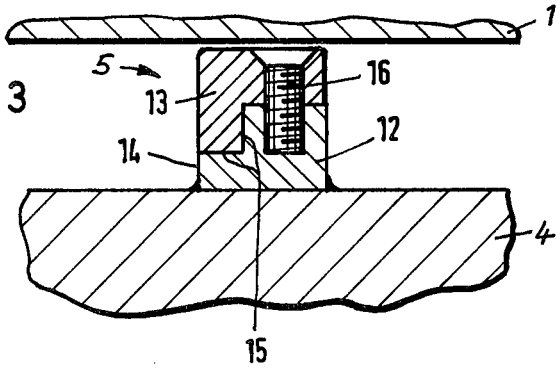
FIG. 3 is a view similar to FIG. 2 but showing a further embodiment.
Figure 4:
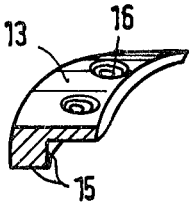
FIG. 4 is a perspective view of an exchangeable segment, as shown in section in FIG. 2.

In FIG. 3 shows that the helical member 5 comprises a base member 12 of helical form welded onto the core of the screw and interchangeable, highly wear-resistant segments 13 mounted on the base member. The base member 5 defines an angular seat 15 provided at the side 14 of base member 12 which is subjected to the main conveying pressure. The interchangeable segments 13, which on their undersides have a similar angular seat 15 (as shown in FIG. 4), lie on the seat 15 of the base member 12 and are fixed to it by screws 16. The helical member formed by the base member 12 and the interchangeable segments 13 can ensure good pressure transmission to the bark, without risk of damage to the helical member.

What we claim is:

1. Apparatus for dewatering a feed material, comprising:

(a) a cylindrical tube, and means for feeding and discharging material to be dewatered to and from said tube;

(b) a rotatable screw mounted in said tube, and means for driving said screw;

(c) helical means mounted on the periphery of said screw and defining with the inner wall of said tube an elongated helical chamber around said screw through which said material is conveyed and put under pressure, said helical means comprising a helical base member rigidly secured to said screw and extending radially outwardly therefrom, and a plurality of interchangeable, exteriorly curved and highly wear-resistant helical segments secured to said helical base member, whereby said helical segments when worn during operation of said apparatus can be readily replaced to present a fresh helical surface;

(d) teeth means projecting into the interior of said chamber for aiding pressure build up in said chamber, said helical means being formed with openings corresponding to the location of said teeth to permit rotation of said screw, and (e) apertures formed in said tube for permitting water pressed from said material to be drained from said chamber.

2. The apparatus of claim 1, wherein the cross-section of said helical means comprises partly said interchangeable, highly wear-resistant helical segments and partly said helical base member.

3. The apparatus of claim 2, wherein said segments are screwed into said helical base member.

4. The apparatus of claim 2, wherein said segments are disposed on the downstream pressure side of said helical base member.

5. The apparatus of claim 1, wherein said segments are made of wear-resistant hard metal.

6. The apparatus of claim 1, wherein said segments are made of a metal-ceramic compound.

7. The apparatus of claim 1, wherein said segments are made of a synthetic polymer with wear-resistant inserts.

8. The apparatus of claim 1 wherein said plurality of helical segments are identical with one another.

9. The apparatus of claim 2, wherein said helical base member is generally L-shape, being formed with a recess at the top and front thereof, considered in the direction of rotation of said screw, to provide an angular seat, and each of said helical segments is similarly L-shape and adapted to be received in said seat, whereby the fronts of said helical segments provide wear surfaces of substantial radial dimension, and means for securing said segments to said helical base member.

* * * * *